US005088748A

United States Patent [19]

Koselka et al.

[11] Patent Number: 5,088,748

[45] Date of Patent: Feb. 18, 1992

[54] ANTI-LOCK BRAKING SYSTEM FOR SKATES

[75] Inventors: Harvey Koselka, Somerville; Andrew R. Jones, Roslindale, both of Mass.

[73] Assignee: Design Continuum Inc., Boston, Mass.

[21] Appl. No.: 635,232

[22] Filed: Dec. 28, 1990

[51] Int. Cl.[5] ..... A63C 17/14

[52] U.S. Cl. ..... 280/11.2; 188/29; 188/74; 280/11.22

[58] Field of Search ..... 188/5, 17, 18 R, 29, 188/26, 74; 280/842, 11.19, 11.2, 11.22

[56] References Cited

U.S. PATENT DOCUMENTS

| | | | |
|---|---|---|---|
| 218,035 | 7/1879 | Lash | 280/11.2 |
| 333,751 | 1/1886 | Harris, Jr. | 280/11.2 |
| 1,974,152 | 9/1934 | Draws | 280/11.2 |
| 2,027,487 | 1/1936 | Means | 280/11.2 |

FOREIGN PATENT DOCUMENTS

| | | | |
|---|---|---|---|
| 8200770 | 3/1982 | PCT Int'l Appl. | 280/11.2 |
| 3201828 | 6/1982 | PCT Int'l Appl. | 280/11.2 |

*Primary Examiner*—Andres Kashnikow

*Assistant Examiner*—Michael Mar

*Attorney, Agent, or Firm*—John P. McGonagle

[57] ABSTRACT

A braking system for an in-line skate wherein an additional wheel is connected to the skate product by a linkage. The linkage is designed to provide progressive braking force on the hub of the additional wheel. The additional wheel is load bearing and can rotate freely when the brake is not actuated. The braking system has a four bar linkage, a preload spring, a load bearing wheel hub and a skate wheel. The four bar linkage is made up of the in-line skate and three linkage bars interconnected in such a manner that they can move relative to one another. Attached to the linkage is a load bearing wheel hub which is attached to a brake wheel. A preload spring is attached to the linkage so that a predetermined force must be applied to the linkage bars before they will move relative to one another. The geometry of the linkage is such that relative bar movement results in a braking force being applied to the wheel hub and thereby to the braking wheel. The preload spring allows the skater to exert high wheel to ground forces which in turn result in greater braking forces without skidding.

4 Claims, 6 Drawing Sheets

ANTI-LOCK BRAKING SYSTEM FOR SKATES

BACKGROUND OF THE INVENTION

This invention relates to wheeled skates, and more particularly to wheeled skates with brakes.

It is known that in-line and tandem skates, rollerskates and skateboards are recreational products designed to allow users freedom of movement by means of rolling wheels. Relatively high speeds of up to 30 mph can easily be attained by beginners on hilly terrains. It is an important safety need that these products provide reliable and adequate means for controlling speed and for bringing the user to a quick and controllable stop should the need arise. Various braking systems have been advanced in the prior art to meet these requirements. Current braking methods and systems for wheeled skates include dragging rubber pads, dragging of the wheels, and/or execution of tight radius turns.

A mounted rubber pad is the most common braking system used today on skates. This system is comprised of a molder rubber plug which is mechanically fastened to a frame and is appropriately positioned with respect to the skate wheels. Mounting locations are usually in front of the toe or just behind the heel. In both cases the plug is positioned approximately one inch above the skating surface. Braking is achieved by tilting the skate forward or backward and dragging the plug/pad across the skating surface. Skateboards utilize pads in a similar way. Skateboard pads are typically mounted to the underside of the board, behind the rear wheels. Braking is achieved by tilting the front of the board upwards causing the pad to drag across the skating surface.

Another braking technique used by skaters is to utilize braking forces created by dragging the skate wheels across the skating surface. This is accomplished by shifting one's weight over one skate and turning the wheels of the second skate perpendicular to the direction of motion and pressing them into the ground, thereby creating a drag.

Still another braking technique is the execution of tight radius turns. This technique manifests itself in a series of "S" turns while traveling down a hill or in a tight circle while stopping at a specific location. Speed is reduced by high lateral forces against the wheels causing the wheels to skid slightly and thereby providing a braking action.

The main purpose and function of a skate braking system is to enable a skater to maintain control over his speed and direction of motion. The limitations of the above braking systems and methods are that they all rely on a skidding action to achieve braking. It has been shown in automobile applications that skidding while braking causes a loss of control. This has led to the development of anti-lock braking systems which reduce brake lock up and thereby skidding. For skaters, skidding also results in a reduction in control requiring additional effort to remain balanced. Directional changes are difficult at best for even expert skaters. Another drawback with current skate braking techniques is the high rate of wear on the brake pads due to the skidding. This changes the shape of the pad resulting in changed and deteriorating braking characteristics. Another problem, especially for beginner and novice skaters, is that it is difficult to control the amount of braking one obtains from a skidding pad. Actuation of the brake results in an immediate and often unpredictable dragging force as the pad contacts the ground. The immediacy and character of the braking effect is determined by the physical properties of the pad and ground. The result is a disruption to balance and control as the skater has great difficulty in gradually building braking forces to desired levels.

SUMMARY OF THE INVENTION

In view of the foregoing disadvantages inherent in the known types of devices now present in the prior art, the present invention provides an improved braking system for wheeled skate products. As such, the general purpose of the present invention, which will be described subsequently in greater detail, is to provide a new and improved progressive braking system for wheeled skate products.

To attain this, the present invention provides an additional wheel connected to the wheeled skate product by a linkage. The linkage is designed to provide progressive braking force on the hub of the additional wheel. The additional wheel is load bearing and can rotate freely when the brake is not actuated. Specifically, the invention has a four bar linkage, a preload spring, a load bearing wheel hub and a skate wheel. The four bar linkage is made up of the product (skate or skate board) and three bars interconnected in such a manner that they can move relative to one another. Attached to the linkage is a load bearing wheel hub which is attached to a brake wheel. A preload spring is attached to the linkage so that a predetermined force must be applied to the linkage bars before they will move relative to one another. The geometry of the linkage is such that relative bar movement results in a braking force being applied to the wheel hub and thereby to the braking wheel. The preload spring allows the skater to exert high wheel to ground forces which in turn result in greater braking forces without skidding.

The braking wheel can be mounted in front or back of a skate or skateboard product. In the case of a rear mounted brake, the braking is actuated by shifting one's weight back onto the braking wheel, thereby distributing weight between the products's rear wheel(s) and the additional braking wheel. The weight distribution determines the amount of actual braking force on the braking wheel. This permits the skater to progressively determine the desired braking force and avoid brake lock up. A further advantage to the instant invention braking system is that it does not require skidding of the rear wheel. As a result there is no loss of control while braking. The rotating brake wheel maintains the smooth forward motion of the product wheels and allows turns (changes in direction) to be executed while predictable braking forces are applied. An additional advantage to the instant invention is the longer life of the braking system due to reduced frictional forces on the braking wheel and increased frictional forces on the hub. The wheel is made of a softer material than the hub. Still another advantage of the present invention is that higher braking forces can be maintained because the braking wheel does not skid. As greater weight is placed over the braking wheel greater braking forces result, but the force required to induce a skid on the brake wheel also increases.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE PREFERRED EMBODIMENT

Figure 1:
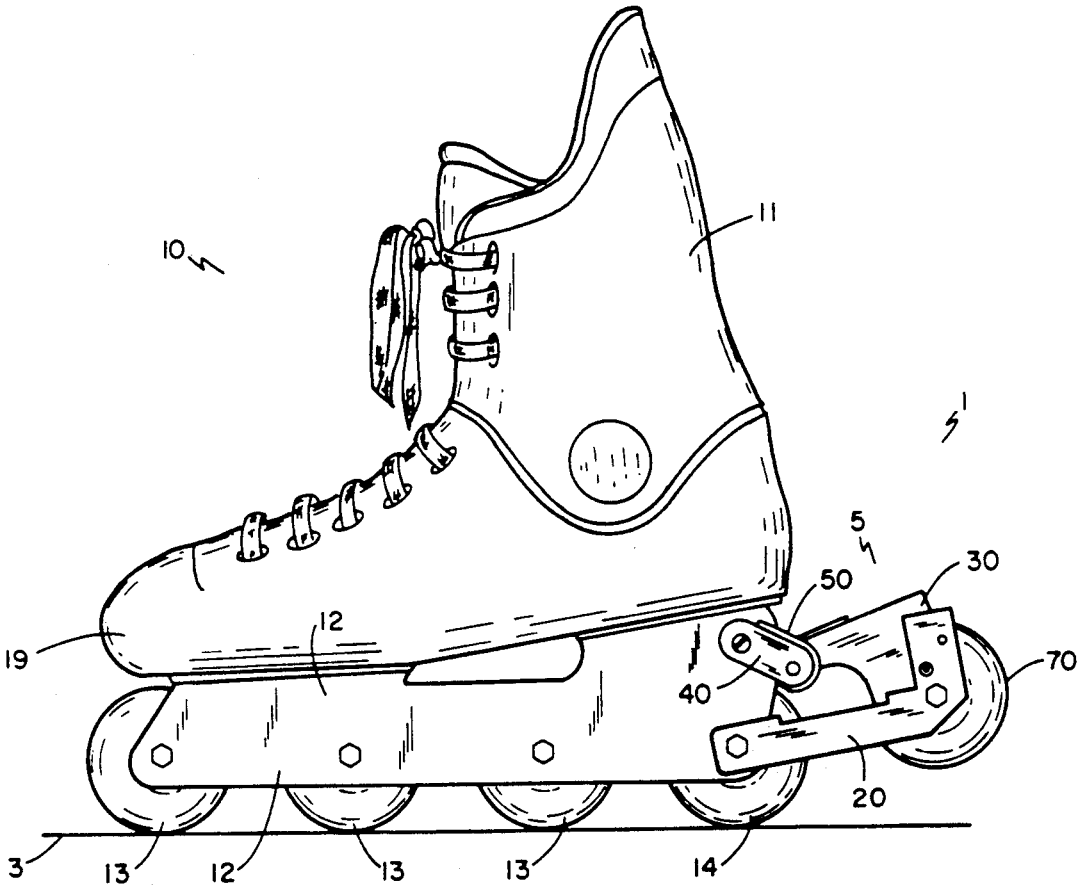
FIG. 1 is a side view of an in-line skate product incorporating a braking system according to the instant invention.

Referring to the drawings in detail wherein like elements are indicated by like numerals, there is shown an in-line skate 10 incorporating a anti-lock braking system 1 in accordance with the present invention. The in-line skate 10 is comprised of shoe portion 11, an in-line skate frame 12 and four skate wheels 13, the rearmost one of which will be designated with reference numeral 14. The braking system 1 has a four bar linkage 5, a preload spring 50, load bearing wheel hubs 60 and a brake wheel 70. The four bar linkage 5 is made up of the in-line skate 10 and three interconnected linkages 20, 30 and 40 connected in such a manner that they can move relative to one another. Attached to the linkage 5 are the load bearing wheel hubs 60 which are attached to the brake wheel 70. A preload spring 50 is attached to the linkage 5 so that a predetermined force must be applied to the linkage bars before they will move relative to one another.

The in-line skate frame 12 forms the actual first linkage of the four bar linkage 5. The second linkage 20 has an H-shaped portion 21 connected to the first linkage 12 near the ends of it forward legs 22 by means of a bolt 15. The bolt 15 is inserted either through the rear wheel axle 16 of the rearmost in-line skate wheel 14 or actually forms the axle itself. The bolt 15 is secured by a double nut 17. In the brake's resting state the H-shaped portion 21 is oriented in a plane nearly parallel to the skating surface 3 at an approximate 10 degree angle off of the in-line skate frame longitudinal axis. Each of the H-shaped portion rearward legs 24 terminate in a second portion 25 rising approximately vertically at right angles to the H-shaped portion 21. The junctions 26 of the H-shaped portion rearward legs 24 and second portions 25 have a hole 27 through which a bolt 28 is inserted. This bolt 28 is secured by a double nut 29 and acts as an axle for a brake wheel 70 which is positioned between the junctions 26. The wheel 70 has a load bearing wheel hub 60 on each side, and both the wheel 70 and hubs 60 are located between the second link junctions 26. In this embodiment of the invention 1 the brake wheel axle 28 is located approximately 3 to 3.5 inches rearward of the rearmost skate wheel axle 16.

The third linkage 30 is pivotally attached to the second linkage 20 by means of two bolts 31, each of which is secured through a hole 32 (not shown) formed in each of the second linkage second portions 25 above the junction holes 27 and through corresponding holes 33 (not shown) in the third linkage 30. The third linkage 30 is comprised of a rectangularly shaped member with flanges 34 extending downwardly from the member's long sides. The longitudinal axis of the third linkage 30 is coincident with the longitudinal axis of the skate 10. The attachment holes 33 are located proximate to the junction of the rear and bottom edges of each flange 34. The flange bottom edges 35 are shaped cocavely over the brake wheel hubs 60. The forward end of the third linkage has a hole 36 (not shown) formed on either side.

The fourth linkage 40 is comprised of two flat, elongated members with forward 42 and rearward 43 holes (not shown) formed therein. The fourth linkage 40 pivotally attaches to the third linkage 30 by means of a bolt 41 through each third linkage forward hole 36 and fourth linkage rearward hole 43. The forward ends of the fourth linkage 40 are pivotally attached to the in-line skate frame 12 at a point 1½ to 2 inches above the rearmost skate wheel axle 16 by means of a bolt 44 and nut 45 inserted through the fourth linkage forward holes 42 (not shown) and corresponding holes 18 (not shown) formed in the in-line skate frame 12.

The geometry of the linkages is such that movement in any one linkage results in movement in all other linkages. As may be seen in FIG. 2 in the braking system's 1 resting state, the second linkage's 20 longitudinal axis is oriented 10 degrees upward from the skate's 10 longitudinal axis. This position is held by contact made between the second linkage 20 and third linkage 30 at two stop bolts 37 fastened to the second linkage second portions 25 at a point above the linkage joining bolts 31. The stop bolts 37 restrict free movement of the third linkage around the pivot point formed at 31. This results in the brake wheel 70 being elevated and prevents it from dragging when not in use. The linkage 5 is further retained in this position by means of a preload spring 50. The spring 50 is a torsion spring and is attached to the tops 38, 46 of the third 30 and fourth 40 linkages about the linkage junction at 41. The spring 50 imparts an upward force about the hinge axis 41 thereby holding the third linkage flange edges 35 above the wheel hubs 60. Other types of springs, e.g., leaf springs, provided that functionally they prevent the braking system from operation until a predetermiend amount of force is exerted.

Figure 3:
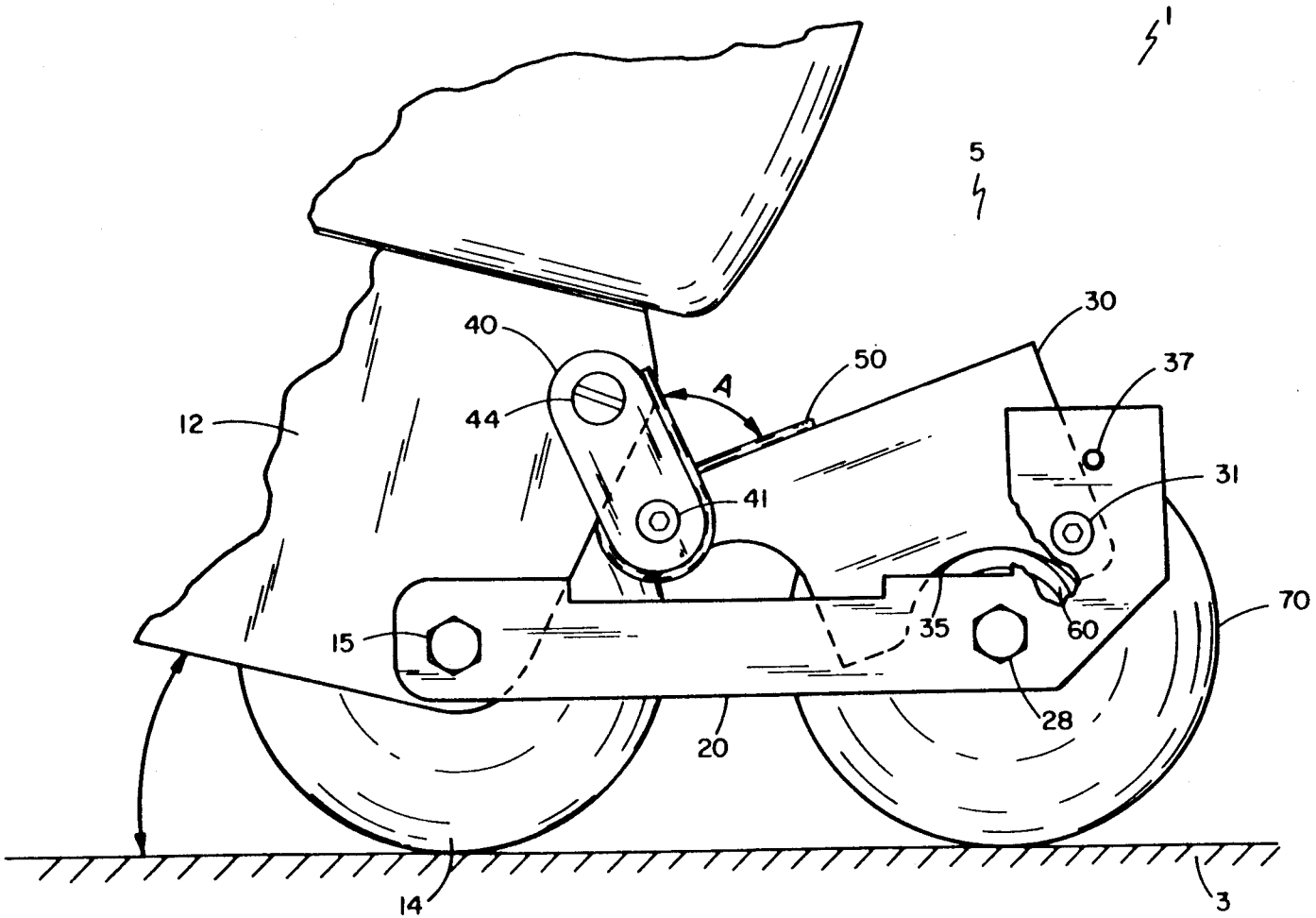
FIG. 3 shows the braking system of FIG. 2 activated.
Figure 4:
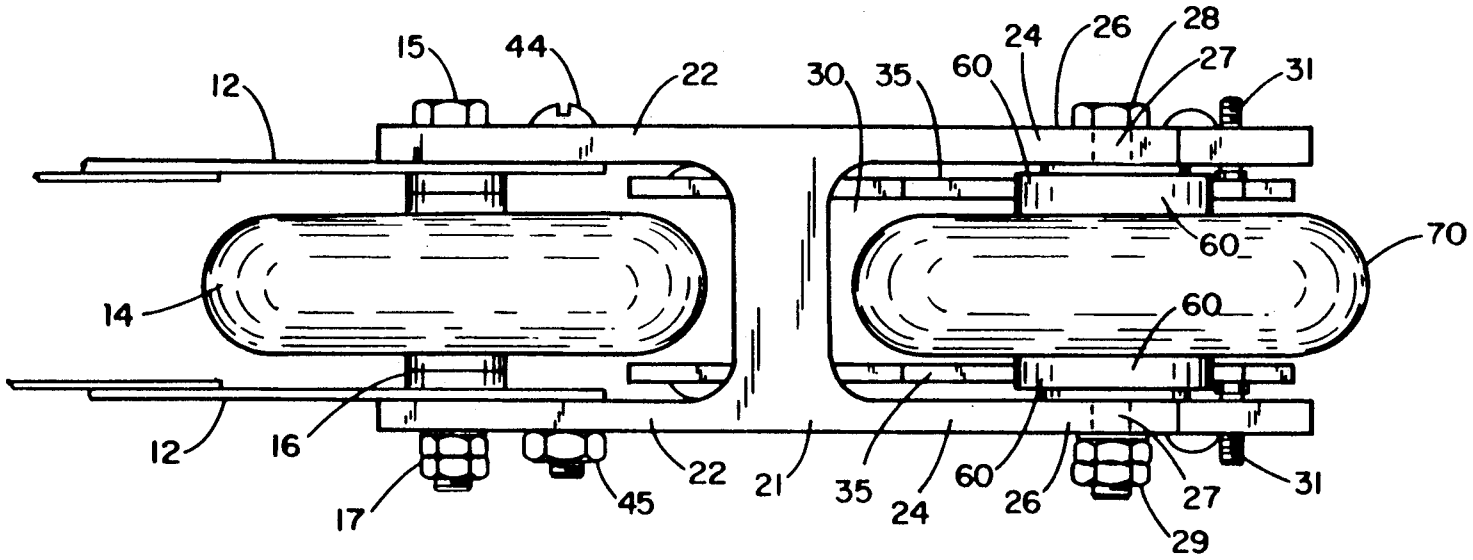
FIG. 4 is a bottom view of the braking system of FIG. 1.

The braking system 1 is actuated by rotating the second linkage 20 about pivot point 15 to the position shown in FIG. 3. The rotational forces are provided by the user tilting the skate up at the toe 19. The rotation causes the brake wheel 70 to contact the ground 3 resulting in relative movement of the brake linkages 5. The linkage geometry is such that the 10 degree angle formed between the longitudinal axis of the first 12 and second 20 linkages is increased due to relative linkage rotation about the connecting bolt 15. This movement causes relative movement in the third 30 and fourth 40 linkages. The distance between the second and third linkage pivot point 31 and the third and fourth linkage pivot point 44 is shortened. As a result the angle A formed between the third 30 and fourth 40 linkages is reduced thereby moving the connecting pivot point 41 closer to the second linkage 20. The movement of the third and fourth linkage connecting pivot point 41 in the direction of the second linkage 20 results in the third linkage flange edges 35 pivoting forward and downward about pivot point 31. As the second 20 and third 30 linkages move closer to one another, the third linkage flange edges 35 contact the wheel hubs 60 which are attached to the second linkage 20 at 28 thereby causing a frictional braking force.

The geometry of the linkage is designed to provide a mechanical advantage of 1:10 such that 10 pounds of force applied to the brake wheel 70 will result in 100 pounds of force applied through the linkage 5 to the wheel hubs 60.

As a result of the relative movement of the third 30 and fourth 40 linkages opening force is exerted on the preload spring 50. The spring 50 resists the opening force and attempts to restrain the relative movement of the linkage system 5. As a result a force greater than the preload spring 50 must be imparted to the wheel 70 before the braking system 1 will activate. As a result, the additional downforce which must be applied to the wheel to activate the braking system 1 causes the wheel 70 to increase its grip on the ground 3 and thereby allowing greater braking forces without locking the brake wheel 70 and causing skidding.

Figure 2:
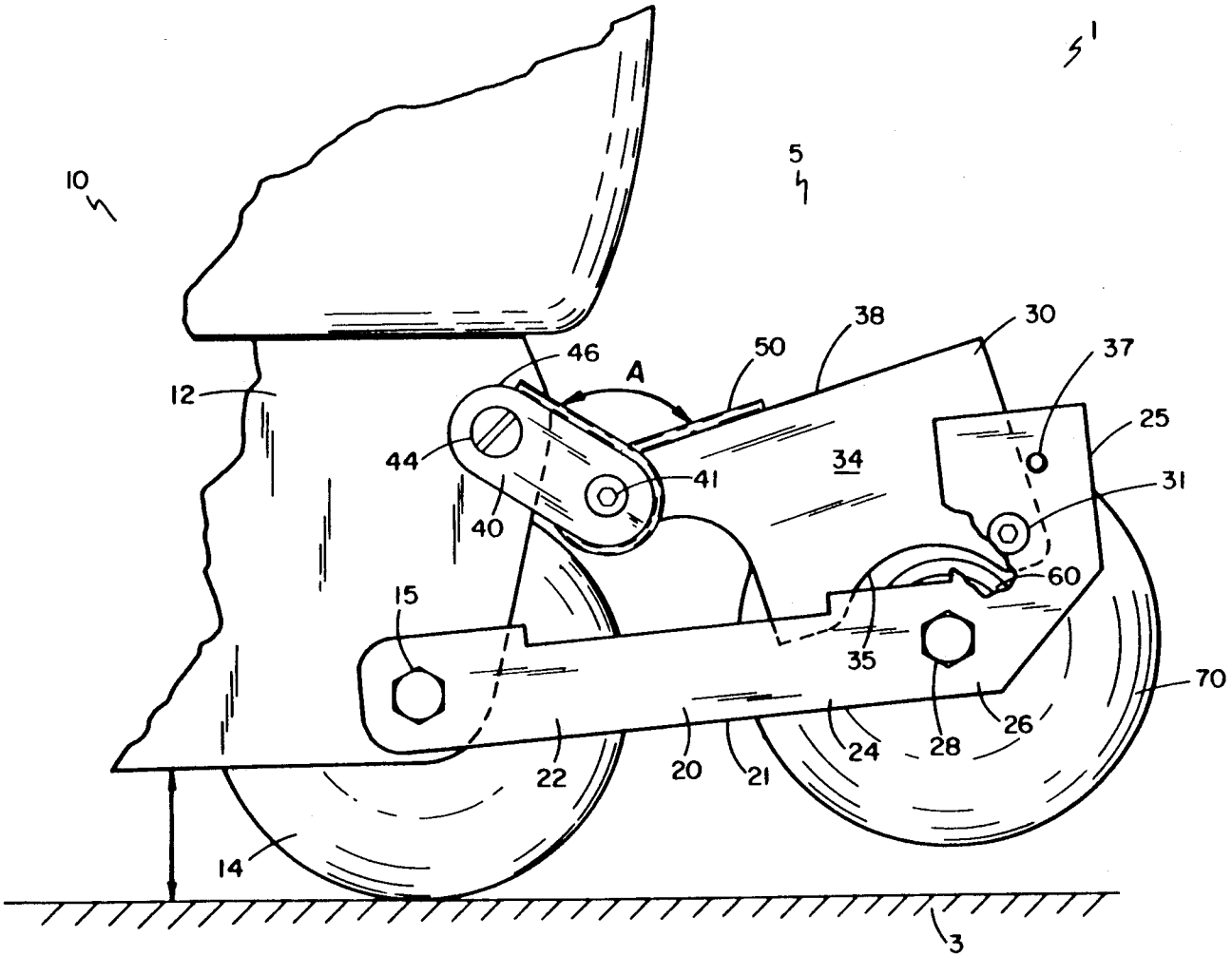
FIG. 2 is a side plan view of the braking system of FIG. 1.
Figure 5:
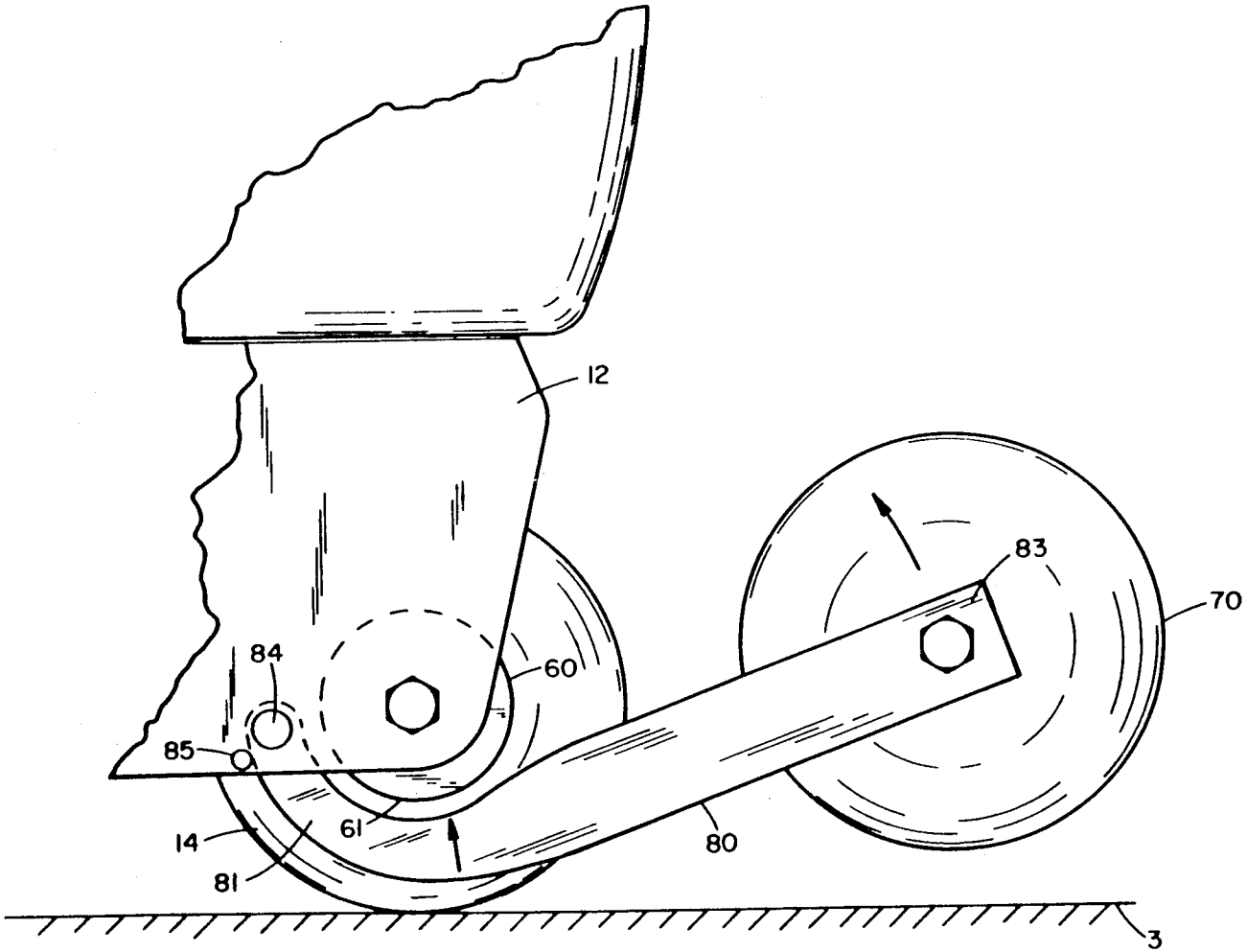
FIG. 5 is a side plan view of another embodiment of a braking system according to the instant invention.
Figure 6:
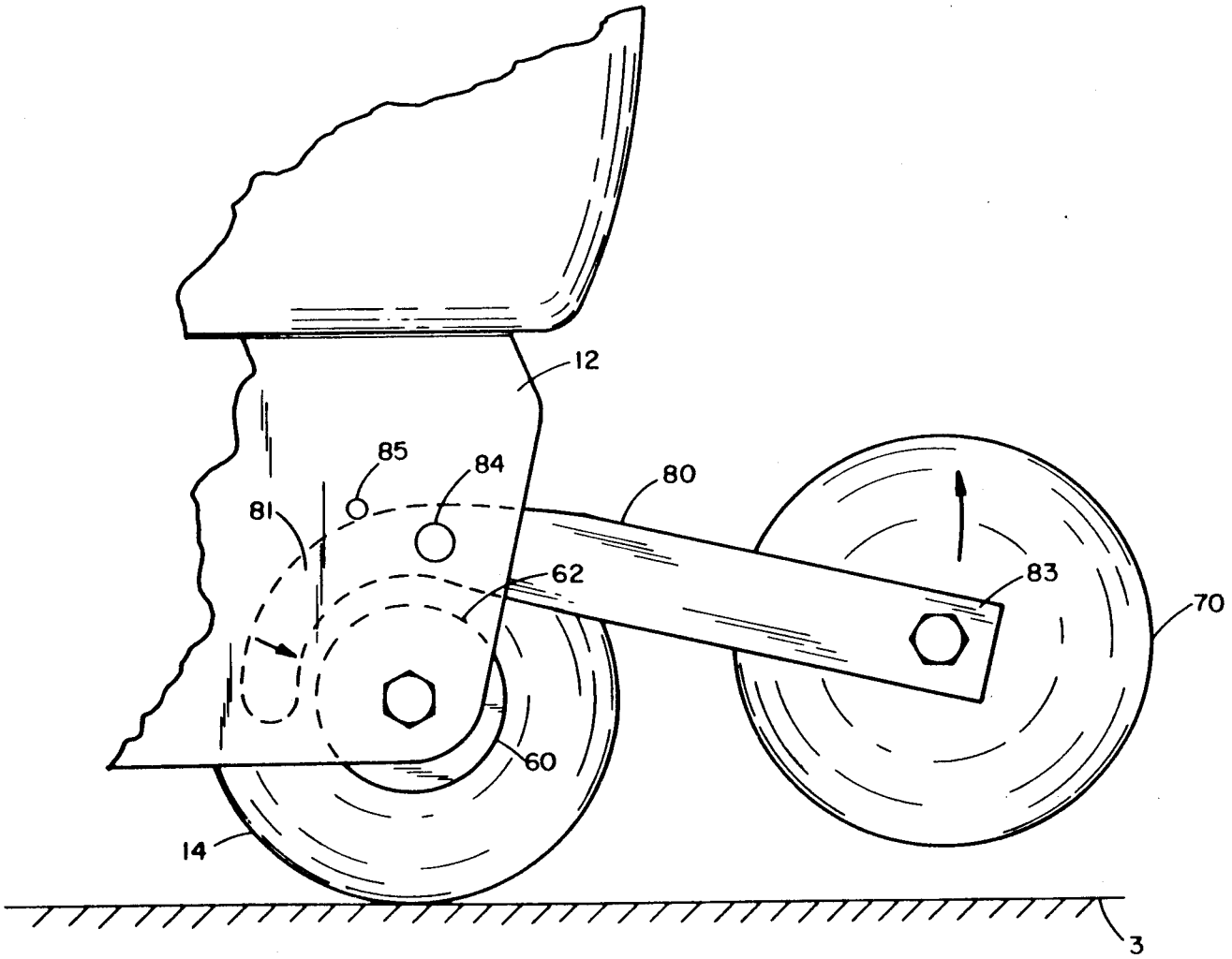
FIG. 6 is a side plan view of a variation of the embodiment shown in FIG. 5.

FIGS. 5 and 6 disclose another embodiment 2 of the invention with two different implementations. In this embodiment the four bar linkage 5 of FIGS. 1–3 is replaced with a braking bar 80. The braking bar 80 interconnects a braking wheel 70 with the in-line skate frame 12. The in-line skate rearmost skate wheel 14 has a load bearing hub 60 added to at least one side. The braking bar forward portion 81 is curved upwardly about the underside 61 of the hub 60 (FIG. 5) or curved downwardly about the topside 62 of the hub 60 (FIG. 6). The forward braking bar portion 81 is pivotally connected to the in-line skate frame 12 by means of a bolt 84. The rearward braking bar end 83 has a braking wheel 70 or skid pad (not shown) attached thereto. The braking wheel 70 or skid pad is normally positioned to the rear of the rearmost skate wheel 14 and elevated above the skating surface 3 so that under normal operation the braking wheel 70 or skid pad does not engage the skating surface 3. A stop bolt 85 is inserted through the skate frame 12 and positioned to engage the braking bar 80 so that the braking wheel 70 is held up off the skating surface 3. The position of the stop bolt 85 does not interfere with the braking bar 80 during braking operations. The braking bar 80 may be a single member on either side of the rearmost wheel 14 or it can be comprised of a double member or yoke arrangement engaging braking hubs 60 on both sides of the rearmost skate wheel 14.

The braking system 1 is actuated by the user tilting the skate 10 up at the toe 19 (not shown). This causes positional rotation about the rearmost wheel 14 causing the brake wheel 70 (or skid pad) to contact the ground 3 resulting in relative movement of the braking bar 80. As upward rotation of the skate about the rearmost wheel 14 increases, the braking bar forward portion engages either the underside 61 (FIG. 5) or topside 62 of the rearmost wheel's hub 60. The braking wheel 70 will continue to rotate thereby providng rotational control to the skater while braking. If a pad is used instead of a braking wheel, a stronger braking action will be experienced.

It is understood that the above-described embodiment is merely illustrative of the application. Other embodiments may be readily devised by those skilled in the art which will embody the principles of the invention and fall within the spirit and scope thereof. Bolts may be replaced with equivalent fasteners. In the first embodiment specified above, the second, third and fourth bar linkages may be made of steel, aluminum, or plastic. The third and fourth bar linkages may also be combined so long as the equivalent function is maintained. The fourth linkage may have an H-shaped yoke arrangement similar to the second linkage for additional strength. The braking wheel of either of the embodiments shown above could also be replaced with a pad. The trade off between wheel and pad has to do with control versus braking power. The pad provides additional braking power. The wheel provides additional control. Although the embodiment shown was a wheeled skating device of the in-line roller skate type, the present invention is equally applicable to skate boards, twin wheeled roller skates, and similar type products.

We claim:

1. In a wheeled skating device having a frame, at least one rear wheel attached to the frame, and a braking system attached to the rear of the skating device, said braking system comprising:

a braking wheel with load bearing hubs; and a four bar linkage arrangement comprised of a first linkage bar formed by the rear portion of said frame, a second linkage bar having a front portion pivotally connected to a lower portion of said first linakge bar and a rear portion, means for rotatably supporting the hubs of said braking wheel to a lower end of said rear portion of said second linkage bar, a third linkage bar having a downwardly facing lower surface for engaging the hubs of said braking wheel, said third linkage bar having a rear portion with a lower end pivotally connected to an upper end of the rear portion of said second linkage bar, and a fourth linkage bar having a rear portion pivotally connected to a front portion of said third linkage bar and a front portion pivotally connected to an upper portion of said first linkage bar, a spring connected between said third linkage bar and said fourth linkage bar for biasing the pivotal connection between said third and fourth linkage bars in an upward direction, and a stop member mounted on an upper end of the rear portion of said second linkage bar for engaging a rear edge of said third linkage bar at a location above the pivotal connection between said second and third linkage bars.

2. A braking system in accordance with claim 1 wherein said third linkage bar has downwardly extending parallel flanges with concavely shaped bottom edges.

3. A braking system in accordance with claim 1 wherein said second linkage bar rear portion terminates in a vertically upward portion, said stop member being attached to said upward portion for restricting rearward movement of said third linkage bar, whereby the longitudinal axis of the second linkage bar is oriented upwardly from the longitudinal axis of the wheeled skate device.

4. A braking system in accordance with claim 3 wherein said third and fourth linkage bars form an upper angle of less than 180 degrees.

* * * * *